US008454103B2

(12) United States Patent
Jeon et al.

(10) Patent No.: US 8,454,103 B2
(45) Date of Patent: Jun. 4, 2013

(54) REFRIGERATOR

(75) Inventors: Jong Su Jeon, Seongnam-si (KR); Sei Ill Jeon, Gimpo-si (KR); Jong Youn Kim, Seoul (KR); Jang Won Kim, Seoul (KR); Tai Kyung Kim, Seoul (KR); Yoo Jin Jung, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/137,429

(22) Filed: Aug. 15, 2011

(65) Prior Publication Data

US 2012/0043873 A1 Feb. 23, 2012

(30) Foreign Application Priority Data

Aug. 19, 2010 (KR) ..... 10-2010-0080067

(51) Int. Cl.

| | |
|---|---|
| ***F25D 25/02*** | (2006.01) |
| ***F25D 25/00*** | (2006.01) |
| ***A47B 96/04*** | (2006.01) |
| ***E06B 1/00*** | (2006.01) |

(52) U.S. Cl.

USPC ..... 312/405.1; 62/382; 62/465; 312/321.5

(58) Field of Classification Search

USPC ..... 312/405, 404, 408, 326, 329, 296, 312/304, 311, 324, 334.23, 334.24, 334.27–334.29, 334.31–334.34, 292, 310, 312/309, 321.5, 405.1; 16/389, 390; 62/382, 62/465, 531, 297

See application file for complete search history.

(56) References Cited

U.S. PATENT DOCUMENTS

| | | | | |
|---|---|---|---|---|
| 965,253 | A * | 7/1910 | Tate | 312/217 |
| 1,209,080 | A * | 12/1916 | Tower | 312/296 |
| 2,040,634 | A * | 5/1936 | Sekyra | 62/382 |
| 2,100,811 | A * | 11/1937 | Marshall | 220/592.07 |
| 2,309,001 | A * | 1/1943 | Nave et al. | 49/398 |
| 2,591,003 | A * | 4/1952 | Philipp | 49/484.1 |
| 2,825,940 | A * | 3/1958 | Kurtz | 49/366 |
| 2,845,321 | A * | 7/1958 | Saunders et al. | 312/405 |
| 3,077,644 | A * | 2/1963 | Kesling | 49/366 |
| 3,078,134 | A * | 2/1963 | Haynes, Jr. | 312/296 |
| 3,221,375 | A * | 12/1965 | Lewis et al. | 49/478.1 |
| 3,264,047 | A * | 8/1966 | Steiner | 312/405 |
| 5,277,488 | A * | 1/1994 | Cleary et al. | 312/408 |
| 5,779,067 | A * | 7/1998 | Reaney | 211/90.04 |
| 6,220,682 | B1 * | 4/2001 | Vertullo | 312/334.28 |
| 6,253,568 | B1 * | 7/2001 | Peffley | 62/441 |
| 2008/0067900 | A1 * | 3/2008 | Marshall et al. | 312/108 |

FOREIGN PATENT DOCUMENTS

| | | | |
|---|---|---|---|
| JP | 03110375 | A * | 5/1991 |
| JP | 05146336 | A * | 6/1993 |

* cited by examiner

*Primary Examiner* — Janet M Wilkens
*Assistant Examiner* — Andrew Roersma
(74) *Attorney, Agent, or Firm* — Staas & Halsey LLP

(57) ABSTRACT

A refrigerator including left and right doors of rotating opening/closing type and a sliding door between the left and right doors. The left and right rotating opening/closing doors have an improved slim edge structure such that a door thickness is hidden. The sliding door includes door guards to accommodate food.

14 Claims, 10 Drawing Sheets

REFRIGERATOR

CROSS-REFERENCE TO RELATED APPLICATIONS

This application claims the benefit of Korean Patent Application No. 2010-0080067, filed on Aug. 19, 2010 in the Korean Intellectual Property Office, the disclosure of which is incorporated herein by reference.

BACKGROUND

1. Field

Embodiments relate to a refrigerator having an aesthetically pleasing outer appearance owing to a door thickness that is not exposed to the outside.

2. Description of the Related Art

Side by Side refrigerators include a pair of left and right doors rotatable to open or close a freezing compartment or a refrigerating compartment. Bottom freezer refrigerators include an upper door rotatable to open or close an upper refrigerating compartment and a lower door rotatable to open or close a lower freezing compartment.

All these doors have a thickness suitable for thermal insulation and when viewed from the side, the overall thickness of the door is exposed to the outside, causing deterioration in the outer appearance of the refrigerator.

Moreover, the refrigerating compartment or the freezing compartment has an interior space elongated in a front-and-rear width, which makes it difficult to put food into or remove food from a rear region of the refrigerating compartment or the freezing compartment.

In addition, each of the pair of doors has a gasket attached to the rim of a rear surface thereof to keep the storage compartment airtight, and a partition is installed in the storage compartment to come into contact with the gasket when the door is closed. In this case, the partition has a thickness required to come into contact with the gasket, which may deteriorate space utilization of the storage compartment.

SUMMARY

Therefore, it is an aspect to provide a refrigerator having an aesthetically pleasing outer appearance owing to a door thickness that is hidden when viewed from the side.

It is another aspect to provide a refrigerator in which a sliding door having a door guard for food accommodation is arranged between left and right doors that are of rotating opening/closing type.

Additional aspects will be set forth in part in the description which follows and, in part, will be apparent from the description, or may be learned by practice of the invention.

In accordance with one aspect, a refrigerator includes a cabinet in which a storage compartment is defined, and left and right doors forwardly pivotally rotatably coupled to opposite sides of the cabinet via hinge members so as to open or close an open front side of the storage compartment, wherein the cabinet includes a pair of protruding portions extending forwardly from opposite sidewalls thereof by a length corresponding to a thickness of one lateral surface of the left or right door close to the hinge member, and wherein the left and right doors are accommodated in a space between the pair of protruding portions when the left and right doors are closed such that the lateral surfaces of the left and right doors close to the respective hinge members are hidden by the pair of protruding portions.

Each of the protruding portions may include an inner side surface and an outer side surface formed by extending an outer shell of the corresponding sidewall of the cabinet, and the inner side surface may include a convexly curved surface.

The protruding portion may further include a hinge member receptacle formed by cutting the inner side surface to accommodate the hinge member when the left or right door is pivotally rotated.

The lateral surface of the left or right door close to the hinge member may include a concavely curved surface corresponding to the convexly curved surface of the protruding portion so as to surround the protruding portion when the left or right door is pivotally rotated.

Each of the hinge members may have an elongated bar shape and may be bent to prevent a body of the hinge member from interfering with the protruding portion when the left or right door is pivotally rotated.

A rotating shaft of the hinge member may be located in the hinge member receptacle of the protruding portion such that a movable end of the hinge member is rotatably coupled to the protruding portion and a stationary end of the hinge member is fixed to the left or right door.

The left or right door may include a hinge member receptacle and a hinge member passage hole, so as not to interfere with a body of the hinge member when the left or right door is pivotally rotated, and a rotating shaft of the hinge member may be located in the left or right door such that a movable end of the hinge member is rotatably coupled to the left or right door and a stationary end of the hinge member is fixed to the protruding portion.

A thickness of the left or right door may increase forward from one lateral surface close to the hinge member toward the other lateral surface.

The refrigerator may further include a sliding door including door guards stacked in multiple stages to accommodate food, the sliding door being slidable forwardly or rearwardly to open or close the storage compartment, and the sliding door may be provided between the left and right doors.

Each of the left and right doors may include a gasket to hermetically seal the storage compartment and absorb shock when the left or right door is closed, and the gasket may be provided at the other lateral surface of the left or right door so as to come into contact with a lateral surface of the sliding door when the left or right door is closed.

The sliding door may include a rod-shaped supporting shaft vertically installed to support the multistage food accommodation door guards, and each of the multistage food accommodation door guards may include a through-hole for penetration of the supporting shaft and a clamping device to couple or separate the door guard to or from the supporting shaft.

Opposite lateral sides of the multistage food accommodation door guards may be open to allow food to be stored or retrieved therethrough.

In accordance with another aspect, a refrigerator includes a cabinet in which a storage compartment is defined and a door forwardly pivotally rotatably coupled to one side of the cabinet via a hinge member so as to open or close an open front side of the storage compartment, wherein the cabinet includes a protruding portion extending forwardly from a sidewall thereof by a length corresponding to a thickness of one lateral surface of the door, and wherein the lateral surface of the door close to the hinge member is hidden by the protruding portion when the door is closed.

The protruding portion may include an inner side surface and an outer side surface formed by extending an outer shell of the sidewall of the cabinet, and the inner side surface may include a convexly curved surface.

The protruding portion may further include a hinge member receptacle formed by cutting the inner side surface to accommodate the hinge member when the door is pivotally rotated.

The lateral surface of the door close to the hinge member may include a concavely curved surface corresponding to the convexly curved surface of the protruding portion so as to surround the protruding portion when the is pivotally rotated.

The hinge member may have an elongated bar shape and may be bent to prevent a body of the hinge member from interfering with the protruding portion when the door is pivotally rotated.

A rotating shaft of the hinge member may be located in the hinge member receptacle of the protruding portion such that a movable end of the hinge member is rotatably coupled to the protruding portion and a stationary end of the hinge member is fixed to the door.

The door may include a hinge member receptacle and a hinge member passage hole, so as not to interfere with a body of the hinge member when the door is pivotally rotated, and a rotating shaft of the hinge member may be located in the door such that a movable end of the hinge member is rotatably coupled to the door and a stationary end of the hinge member is fixed to the protruding portion.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
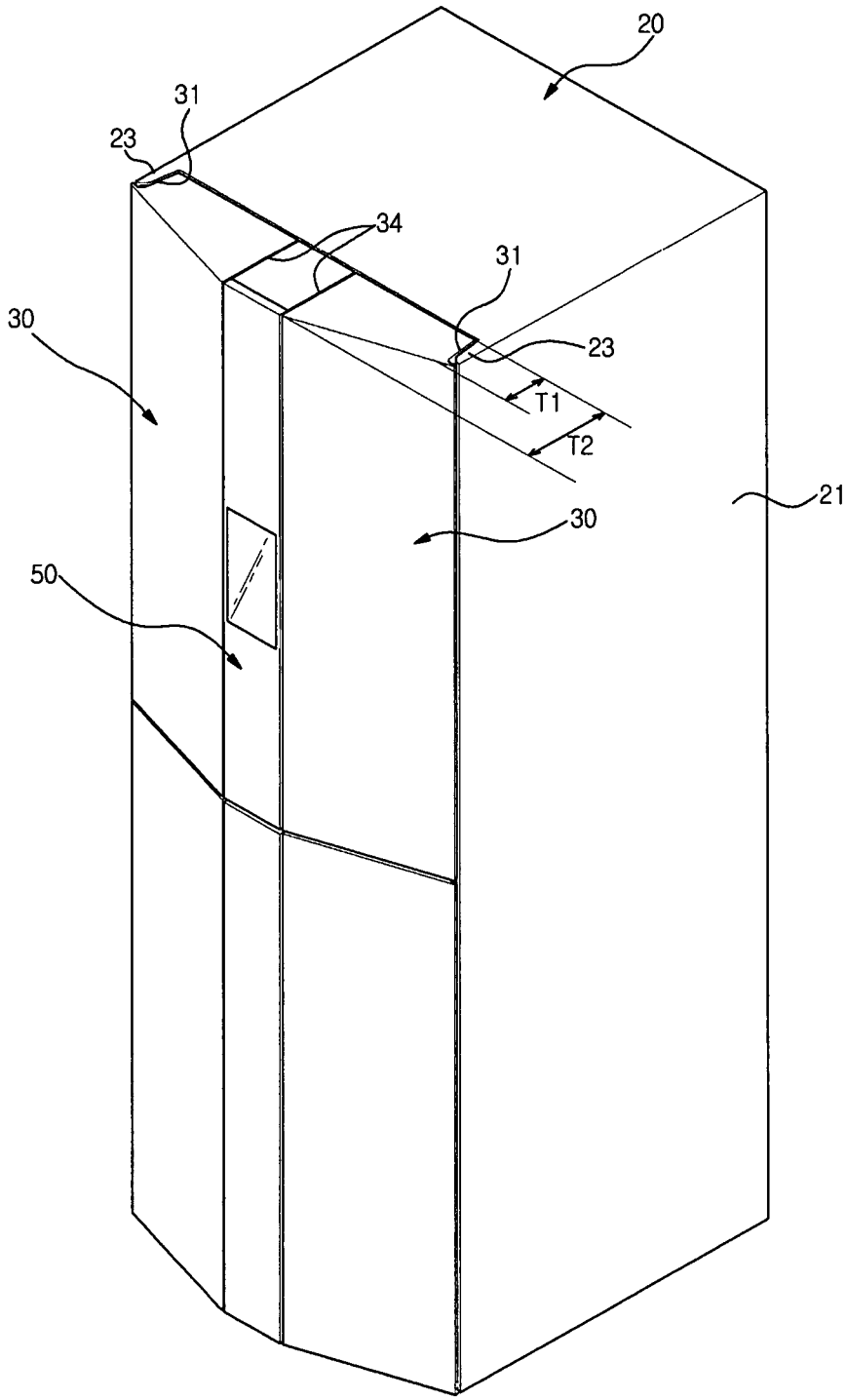
FIG. 1 is a perspective view illustrating a closed state of doors provided in a refrigerator according to an embodiment.

Reference will now be made in detail to the embodiments, examples of which are illustrated in the accompanying drawings, wherein like reference numerals refer to like elements throughout.

Figure 2:
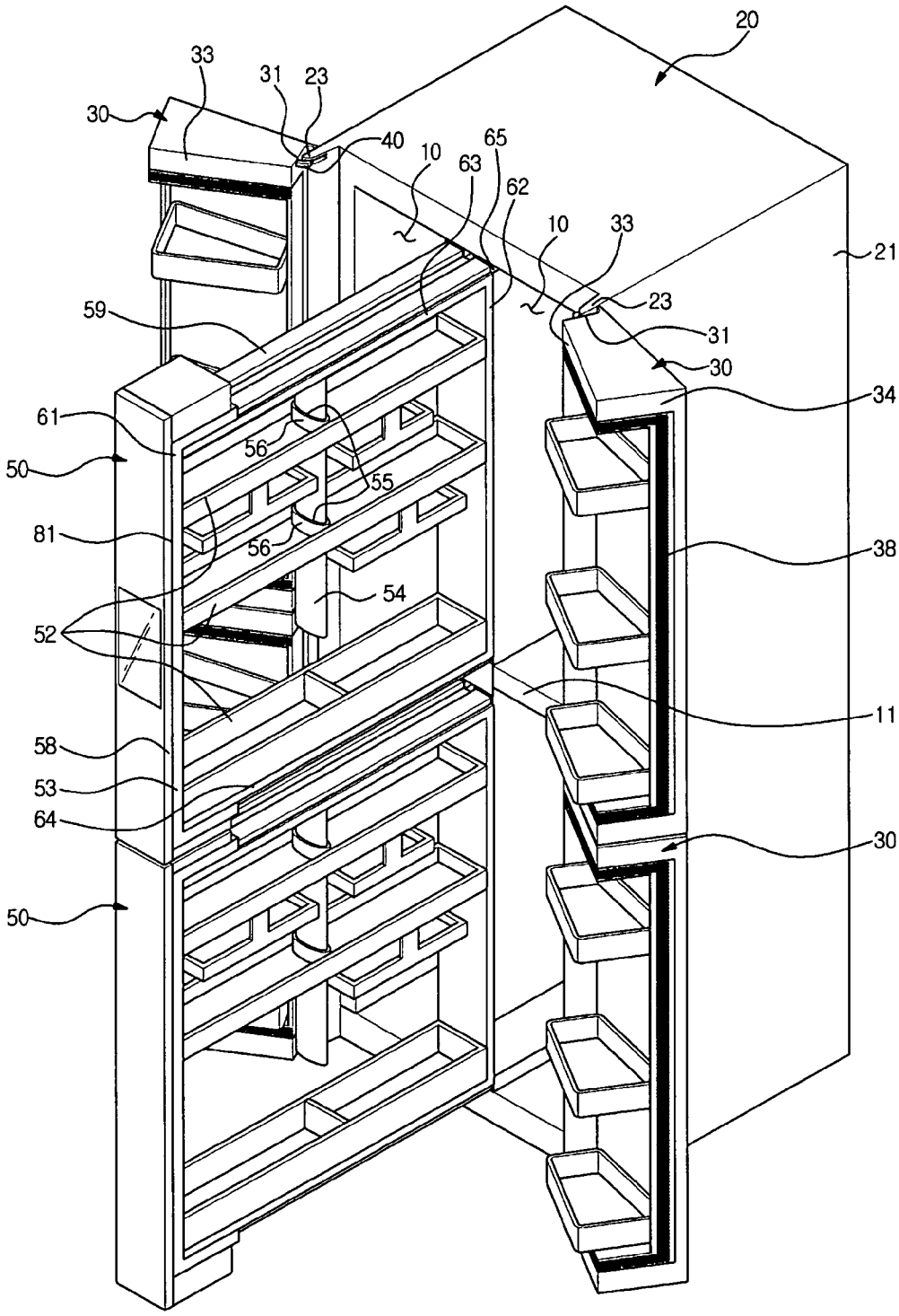
FIG. 2 is a perspective view illustrating an open state of the doors according to the embodiment.
Figure 3:
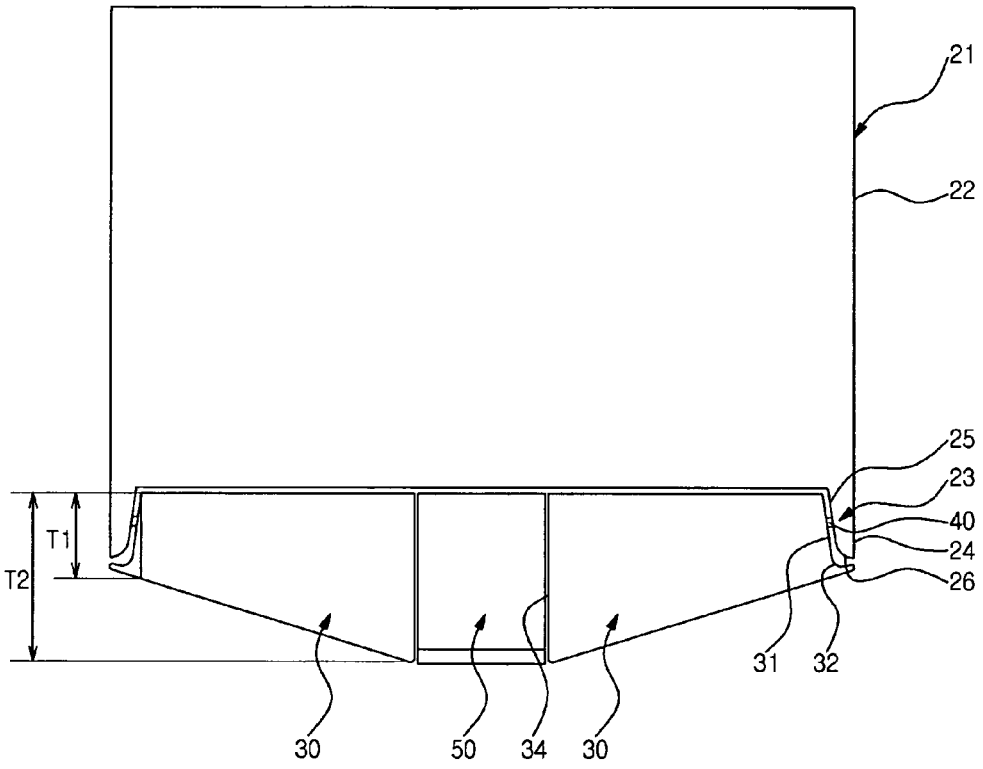
FIG. 3 is a plan view of the refrigerator according to the embodiment.

FIGS. 1 and 2 are perspective views respectively illustrating a closed state and an open state of doors provided in a refrigerator according to an embodiment, and FIG. 3 is a plan view of the refrigerator according to the embodiment.

The refrigerator according to the embodiment includes a cabinet 20, a storage compartment 10 defined in the cabinet 20 to store food, and doors 30 and 50 to open or close a front open side of the storage compartment 10.

The storage compartment 10 is divided into upper and lower storage compartments by a horizontal partition 11. In turn, each of the upper and lower storage compartments are divided into left and right storage compartments by a sliding door 50. All these storage compartments may respectively serve as a freezing compartment or a refrigerating compartment.

Although not illustrated, the storage compartment 10 may contain a vertical partition close to the sliding door 50.

The storage compartment 10 is enclosed by the cabinet 20 to have an open front side, and doors 30 and 50 are provided to open or close the open front side.

The cabinet 20 takes the form of a forwardly open box in which the storage compartment 10 is defined. The cabinet 20 defines the outer appearance of the refrigerator.

In the refrigerator according to the embodiment, the cabinet 20 includes opposite sidewalls 21. Especially, the sidewalls 21 include a pair of protruding portions 23 forwardly extending from the cabinet 20 by a predetermined length.

The doors 30 and 50 include left and right doors 30 of rotating opening/closing type and the sliding door 50.

The left and right doors 30 of rotating opening/closing type are forwardly rotatably coupled to opposite sides of the cabinet 20 by hinge members 40. The sliding door 50 is provided between the left and right doors 30 and serves to open or close the open front side of the storage compartment 10 via forward or rearward sliding.

More particularly, each of the left and right doors 30 according to the embodiment has lateral surfaces 31 and 34 with different thicknesses T1 and T2. In this case, the thickness T1 of one lateral surface 31 close to the hinge member 40 is smaller than the thickness T2 of the other lateral surface 34.

For example, in the left and right doors 30 according to the embodiment, the thickness of the door 30 gradually increases forward from the lateral surface 31 close to the hinge member 40 to the other lateral surface 34.

With the above-described configuration, the left and right doors 30 have a food storage space independently of the storage compartment 10, which may increase the overall storage capacity of the refrigerator.

In addition, unlike a conventional refrigerator simply having a rectangular box shape, the refrigerator according to the embodiment has a slightly forwardly protruding central portion and thus, has stability and an aesthetically pleasing outer appearance even if the refrigerator is wide.

It will be appreciated that the technical idea of the embodiment which will be described hereinafter may be applied even to the refrigerator having the door 30 with a predetermined thickness.

According to the embodiment, additionally, the cabinet 20 includes the pair of protruding portions 23, which are obtained as the sidewalls 21 extend forwardly by a predetermined length.

More specifically, the predetermined length approximately corresponds to the thickness T1 of the lateral surface 31 of the left or right door 30 close to the hinge member 40.

The pair of protruding portions 23 extending forwardly from the sidewalls 21 of the cabinet 20 define a space therebetween, into which the doors 30 and 50 are accommodated.

Here, the left and right doors 30 are coupled to opposite sides of the cabinet 20 and the sliding door 50 is arranged between the left and right doors 30.

Since the pair of protruding portions 23 extend forwardly by approximately the thickness T1 of the lateral surface 31 of the left and right doors 30 close to the hinge members 40 and the left and right doors 30 are accommodated in the space between the pair of protruding portions 23, the thickness T1 of the lateral surface 31 of the left or right door 30 is hidden by the protruding portion 23 and is barely visible when viewed from the side of the refrigerator.

Accordingly, the lateral surface 31 of the door 30 has an extremely thin thickness T1, providing the refrigerator with a clean and fine image.

Figure 4:
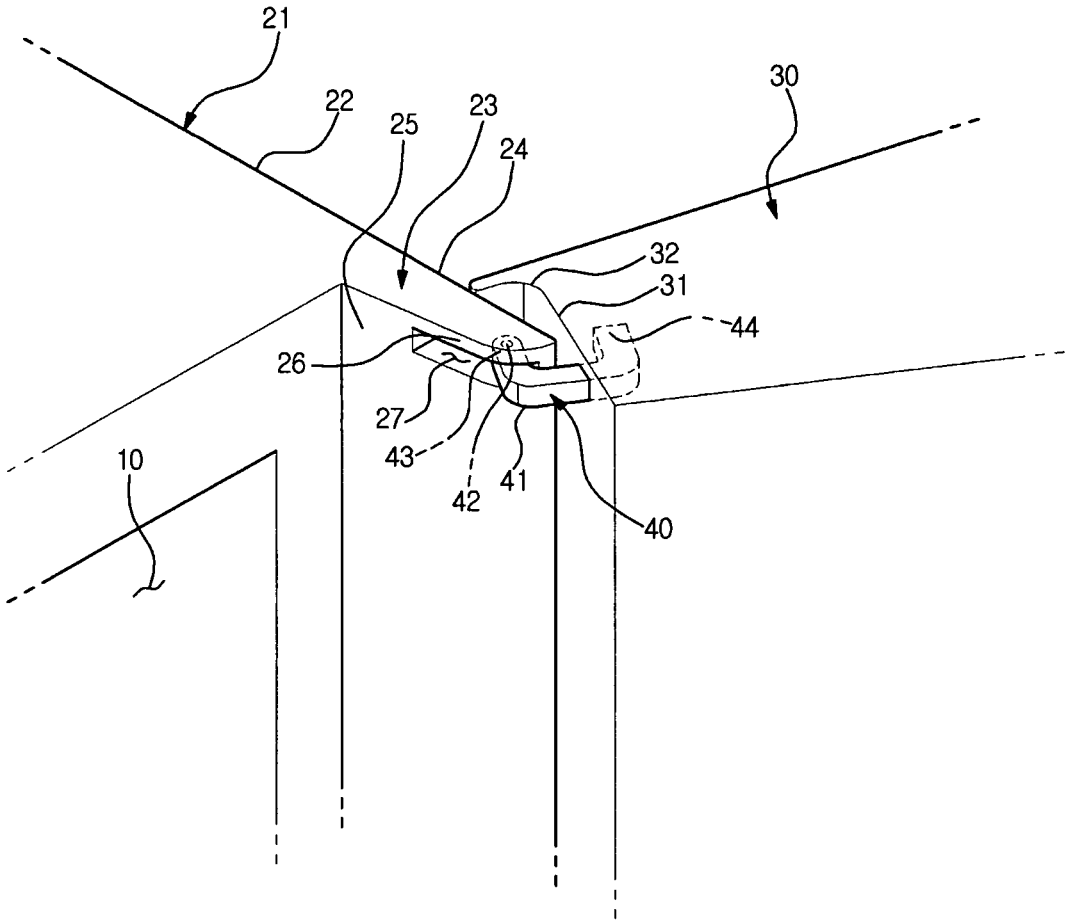
FIG. 4 is a perspective view illustrating a hinge member for a refrigerator according to an embodiment.
Figure 5:
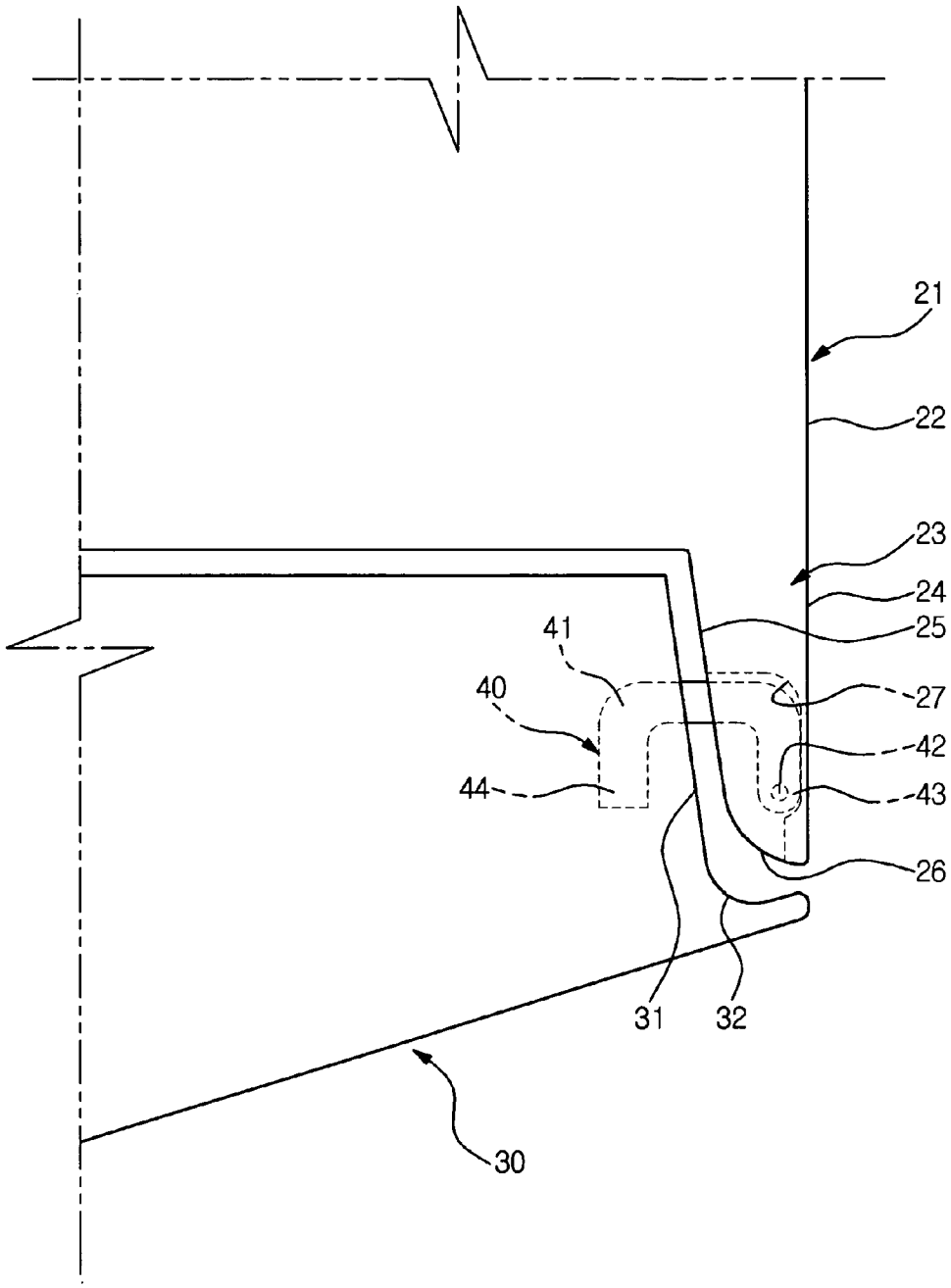
FIG. 5 is a plan view of the hinge member according to the embodiment.
Figure 6:
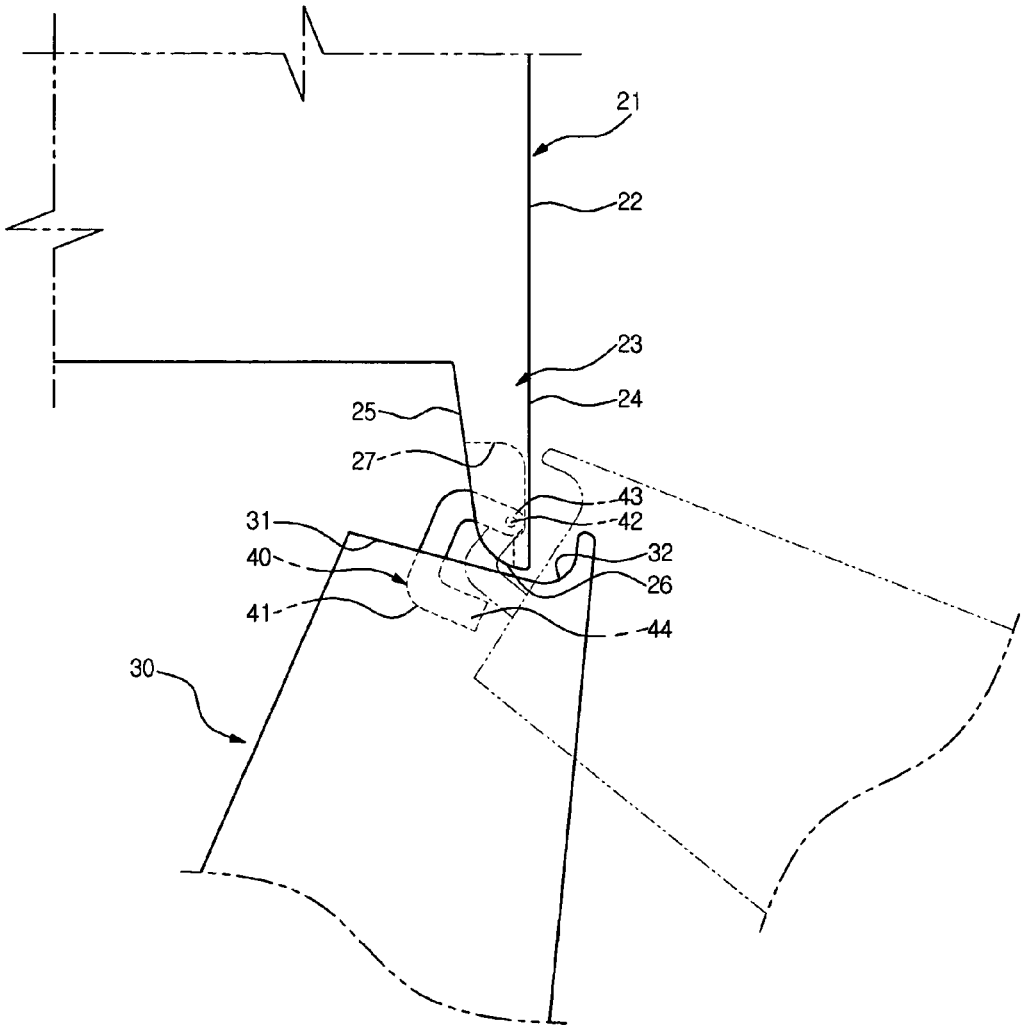
FIG. 6 is a plan view explaining operation of the hinge member according to the embodiment.

FIGS. 4 and 5 are respectively a perspective view and a plan view illustrating the hinge member for the refrigerator according to an embodiment, and FIG. 6 is a plan view explaining operation of the hinge member.

Referring to the drawings, the protruding portion 23 includes an inner side surface 25 and an outer side surface 24 formed by extending an outer shell 22 of the sidewall 21 of the cabinet 20. The inner side surface 25 includes a convexly curved surface 26.

To correspond to the protruding portion 23, the lateral surface 31 of the left or right door 30 close to the hinge member 40 includes a concavely curved surface 32. This configuration allows the left or right door 30 to pivotally rotate about the protruding portion 23 without coming into contact with the protruding portion 23.

The inner side surface 25 of the protruding portion 23 is partially cut to define an empty space, i.e. a hinge member receptacle 27 such that the hinge member 40 is fitted into the hinge member receptacle 27 so as to couple the left or right door 30 to the cabinet 20.

The hinge member 40 basically has an elongated bar shape, but may need a bent shape to prevent a body 41 of the hinge member 40 from coming into contact and interfering with the protruding portion 23 while being rotated about a rotating shaft 42 thereof.

Although the hinge member 40 of the present embodiment has a U-shaped form obtained by bending a bar twice, the hinge member 40 may be bent only once or may have a curvilinear form so long as it does not interfere with the protruding portion 23 during rotation thereof.

The rotating shaft 42 of the hinge member 40 is disposed in the hinge member receptacle 27 formed by cutting the inner side surface 25 of the protruding portion 23.

Thus, a movable end 43 of the hinge member 40 is mounted into the hinge member receptacle 27 and more particularly, is coupled to the protruding portion 23, and a stationary end 44 of the hinge member 40 is fixed to the left or right door 30.

With the above-described configuration, the hinge member 40, which hingedly couples the left or right door 30 to the cabinet 20 in a pivotally rotatable manner, has the movable end 43 and the stationary end 44 located respectively in the protruding portion 23 and the left or right door 30 and is barely visible to the outside, providing the refrigerator with a cleaner outer appearance.

Figure 7:
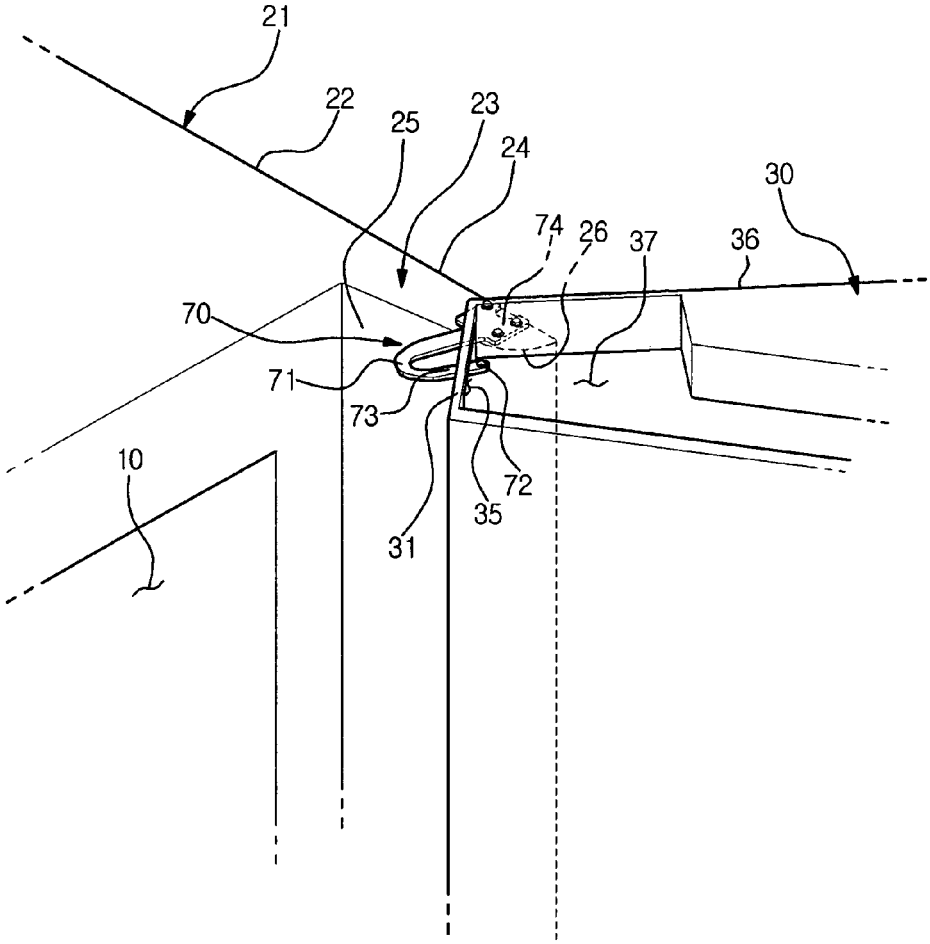
FIG. 7 is a perspective view illustrating a hinge member for a refrigerator according to an embodiment.
Figure 8:
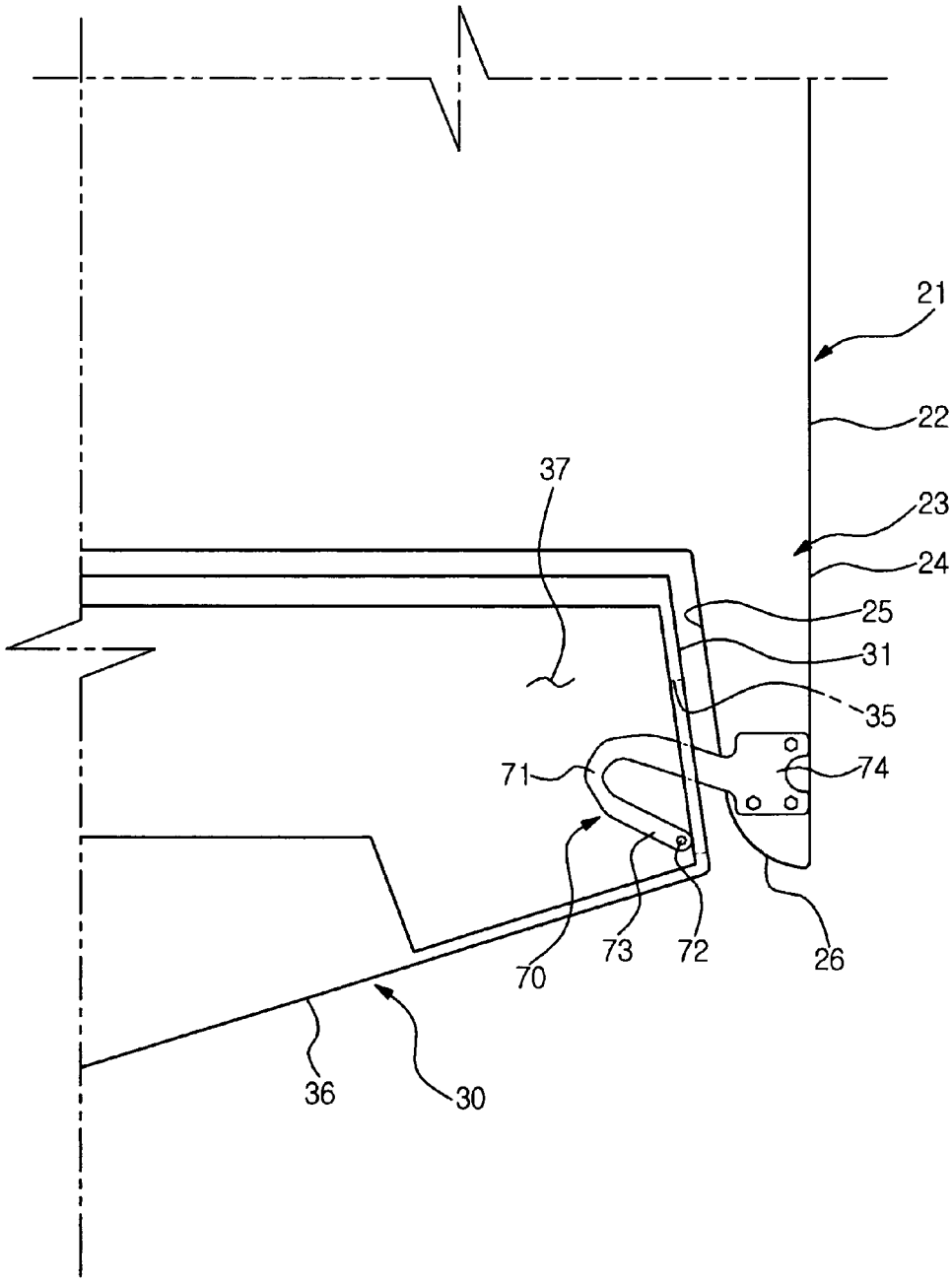
FIG. 8 is a plan view of the hinge member according to the embodiment.
Figure 9:
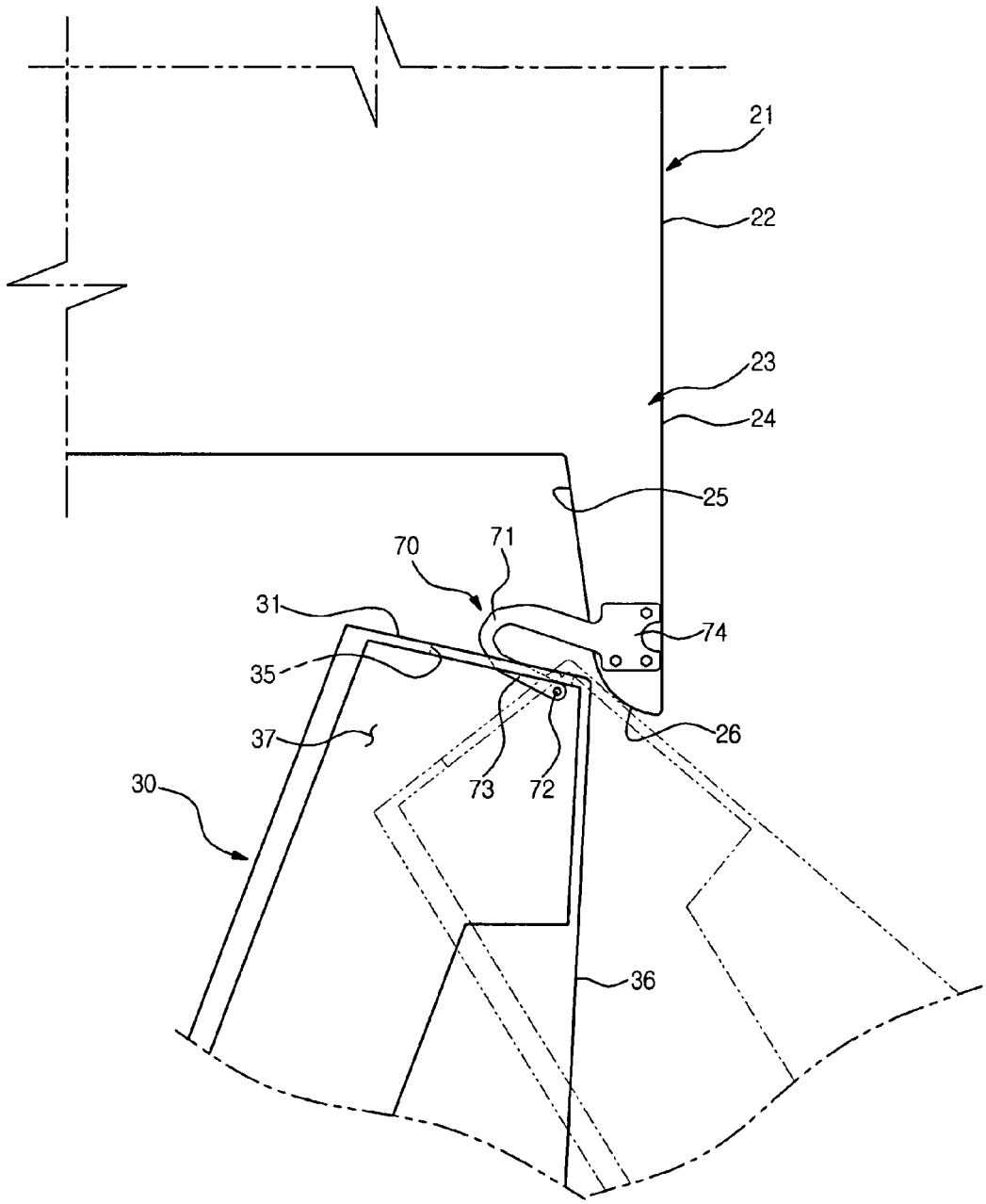
FIG. 9 is a plan view explaining operation of the hinge member according to the embodiment.

FIGS. 7 and 8 are respectively a perspective view and a plan view illustrating a hinge member for the refrigerator according to an embodiment, and FIG. 9 is a plan view explaining operation of the hinge member.

Referring to FIGS. 7 to 9, the hinge member 70 of the refrigerator according to the present embodiment includes a stationary end 74 fixed to the protruding portion 23 and a movable end 73 rotatably coupled to the left or right door 30.

Specifically, the left or right door 30 is rotated about a rotating shaft 72 provided at a position of the left or right door 30, thereby opening or closing the storage compartment 10.

The left or right door 30 has a slightly greater height than the protruding portion 23. The lateral surface 31 of the left or right door 30 is provided with a hinge member passage hole 35 to prevent the left or right door 30 from interference with a body 71 of the hinge member 70 during rotation thereof.

The left or right door 30 includes a hinge member receptacle 37 defined by partially cutting a top portion of the left or right door 30 to accommodate the hinge member 70 therein. When the left or right door 30 is closed, the hinge member 70 is inserted into the hinge member receptacle 37.

Although the present embodiment illustrates the hinge member receptacle 37 as having an open top side, the top of the hinge member receptacle 37 may be closed so long as the hinge member receptacle 37 provides a space sufficient to accommodate the hinge member 70 therein.

When the left or right door 30 is rotated about a rotating shaft 72 to open the storage compartment, the hinge member 70 is drawn out of the hinge member receptacle 37 through the hinge member passage hole 35 and simultaneously, the left or right door 30 is rotated until a front surface 36 of the left or right door 30 comes into contact with the convexly curved surface 26 of the protruding portion 23.

Although the above description is related to a dual door type refrigerator having the two left and right doors 30 rotatably hinged to the cabinet 20, the protruding portion extending forwardly from the sidewall of the cabinet and the hinge member may also be applied to a single door type refrigerator.

Figure 10:
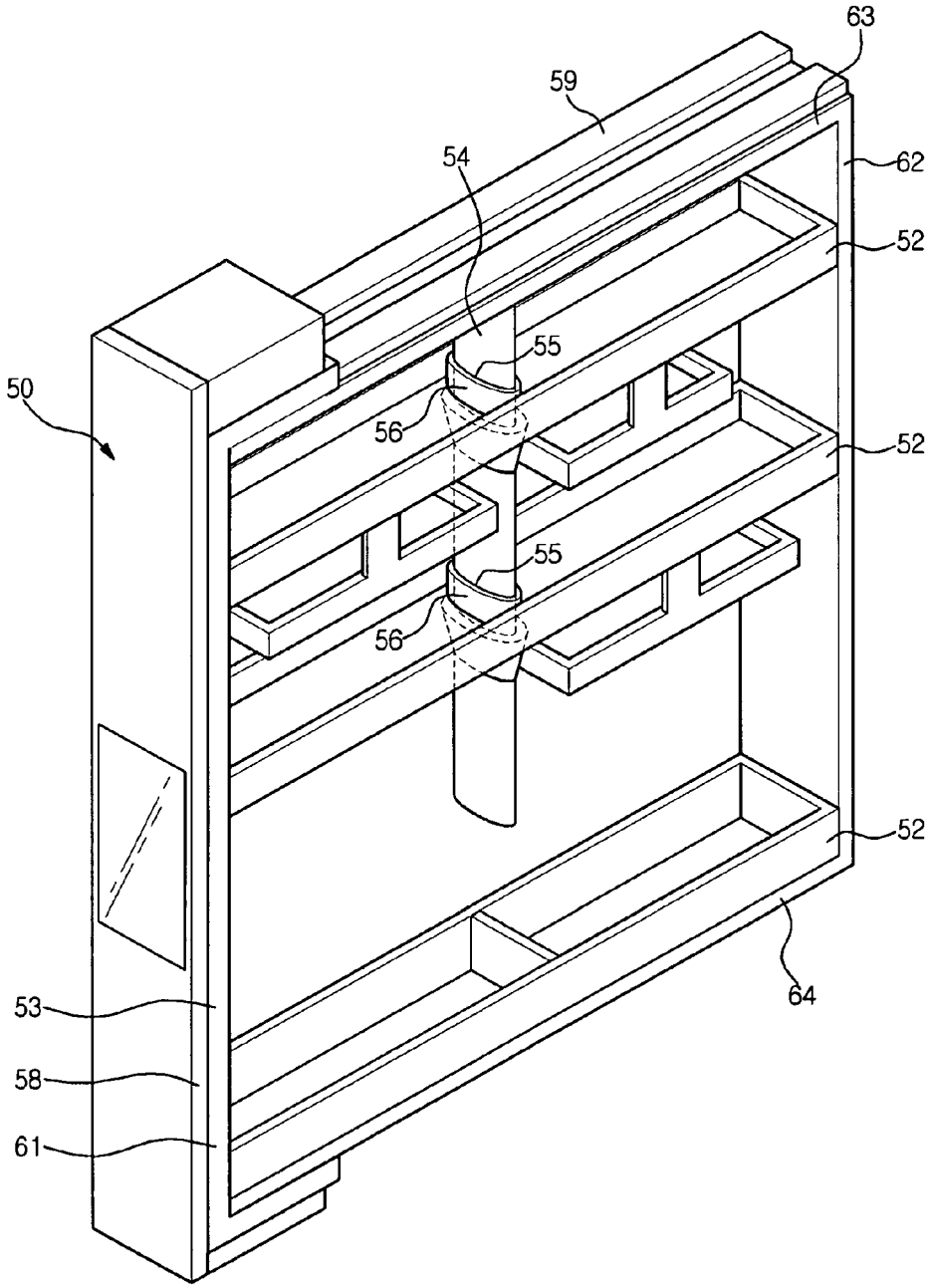
FIG. 10 is a perspective view illustrating a sliding door for a refrigerator according to an embodiment.

FIG. 10 illustrates the sliding door for the refrigerator according to an embodiment.

Referring to FIGS. 1, 2 and 10, the sliding door 50 of the refrigerator according to the embodiment has an elongated shape, a vertical length of which is greater than a horizontal width. The sliding door 50 includes a front frame 61, a rear frame 62, an upper frame 63 and a lower frame 64.

An upper sliding plate 59 is provided at an upper end of the upper frame 63 and a lower sliding plate (not shown) is provided at a lower end of the lower frame 64, to allow the sliding door 50 to be slidably pushed into or pulled from the storage compartment 10.

The cabinet 20 is provided at ceiling and bottom surfaces thereof with an upper rail groove 65 and a lower rail groove (not shown) for sliding insertion of the upper sliding plate 59 and the lower sliding plate (not shown).

The sliding door 50 includes door guards 52 stacked in multiple stages to accommodate food.

The multistage food accommodation door guards 52 are exposed to the outside of the storage compartment 10 as the sliding door 50 is opened, enabling a user to easily retrieve food.

In addition, slidably moving the sliding door 50 forwardly out of the cabinet 20 may help the user to view stored food items at a glance.

In the refrigerator according to the embodiment, the sliding door 50 is provided between the left and right doors 30 and has open lateral sides, which may ensure that the user can conveniently access the food accommodation door guards 52 from left and right sides thereof.

In this case, to prevent slippage and falling of food stored in the door guards 52, a side plate (not shown) may be provided at one of lateral sides of the sliding door 50.

Although not illustrated, the face plate 81 of the sliding door 50 may be provided with a handle, or may be simply opened by pulling.

Also, vertical positions of the food accommodation door guards 52 stacked in multiple stages may be adjustable.

The sliding door 50 is provided at an approximately central position thereof with a supporting shaft 54. The supporting shaft 54 takes the form of a vertical rod to support the food accommodation door guards 52. Each door guard 52 may be provided with a through-hole 55 for penetration of the supporting shaft 54.

Although the supporting shaft 54 of the present embodiment vertically extends downward from the upper frame 63 by a predetermined length such that various sizes of food is stored in the door guards 52, the supporting shaft 54 may further extend to the lower frame 64.

A clamping device 56 is provided at each door guard 52 to couple or separate the door guard 52 to or from the supporting shaft 54.

The door guard 52 is coupled to the supporting shaft 54 as the clamping device 56 is tightened to the supporting shaft 54. On the other hand, as the clamping device 56 is released from the supporting shaft 54, the door guide 52 is separated from the supporting shaft 54 and thus, is vertically movable.

As such, vertical distances between the respective door guards 52 stacked in multiple stages may be changed using the clamping device 56.

The clamping device 56 may be obtained in various ways and for example, may be of a gas compression type.

In the refrigerator according to the embodiment, additionally, the gasket 38 is provided at the rear surface 33 and the lateral surface 31 of the left or right door 30 of rotating opening/closing type. The gasket 38 serves to hermetically seal the storage compartment 10 in a closed state of the left or right door 30 and to absorb shock generated when the left or right door 30 is closed.

In the refrigerator according to the embodiment, since the sliding door 50 is provided between the left and right doors 30 hinged to opposite sides of the cabinet 20, providing the gaskets 38 at the lateral surfaces 34 of the left and right doors 30 causes the gaskets 38 of the left and right doors 30 to come into contact with gasket contact portions 53 provided at lateral surfaces 58 of the sliding door 50 when the doors 30 and 50 are closed, thereby hermetically sealing the storage compartment 10.

This configuration does not need to provide a vertical partition having a gasket contact portion in the storage compartment 10, which expands an available space of the storage compartment 10.

As is apparent from the above description, one or more embodiments may include a refrigerator in which sidewalls of a cabinet protrude to define a door accommodation space therebetween such that a door thickness is barely visible when viewed from the side of the refrigerator, providing the refrigerator with a fine outer appearance.

Further, the resulting protruding portion of the cabinet is provided with a hinge member receptacle such that a hinge member of the door is rotatably inserted into the hinge member receptacle without a risk of exposure to the outside.

Furthermore, a vertically elongated sliding door having door guards is provided between left and right rotating opening/closing doors, enabling easy food storage.

In addition, as a gasket is provided at a lateral surface of the rotating opening/closing door so as to come into contact with a lateral surface of the center sliding door, a separate structure for contact with the gasket may be unnecessary, providing an expanded practical storage space.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a cabinet in which a storage compartment is defined; and left and right doors forwardly pivotally rotatably coupled to opposite sides of the cabinet via hinge members so as to open or close an open front side of the storage compartment, wherein the cabinet includes a pair of protruding portions extending forwardly from opposite sidewalls thereof by a length corresponding to a thickness of one lateral surface of the left or right door close to the hinge member, wherein the left and right doors are accommodated in a space between the pair of protruding portions when the left and right doors are closed such that the lateral surfaces of the left and right doors close to the respective hinge members are hidden by the pair of protruding portions, and wherein a thickness of the left or right door increases forward from one lateral surface close to the hinge member toward the other lateral surface, the thickness of the left or right door at the one lateral surface close to the hinge member being less than the thickness of the left or right door at the other lateral surface, wherein each of the protruding portions includes an inner side surface and an outer side surface formed blending an outer shell of the corresponding sidewall of the cabinet, the inner side surface including a convexly curved surface, wherein the protruding portion further includes a hinge member receptacle formed by cutting the inner side surface to accommodate the hinge member when the left or right door is pivotally rotated, and wherein the lateral surface of the left or right door close to the hinge member includes a concavely curved surface corresponding to the convexly curved surface of the protruding portion so as to surround the protruding portion when the left or right door is pivotally rotated.

2. The refrigerator according to claim 1, wherein a rotating shaft of the hinge member is located in the hinge member receptacle of the protruding portion such that a movable end of the hinge member is rotatably coupled to the protruding portion and a stationary end of the hinge member is fixed to the left or right door.

3. The refrigerator according to claim 1, wherein each of the hinge members has an elongated bar shape and is bent to prevent a body of the hinge member from interfering with the protruding portion when the left or right door is pivotally rotated.

4. The refrigerator according to claim 1, wherein the left or right door includes a hinge member receptacle and a hinge member passage hole, so as not to interfere with a body of the hinge member when the left or right door is pivotally rotated.

5. The refrigerator according to claim 1, wherein a thickness of the left and right doors increase forward from one lateral surface close to the hinge member toward the other lateral surface of each of the left and right doors.

6. The refrigerator according to claim 1, further comprising a sliding door including door guards stacked in multiple stages to accommodate food, the sliding door being slidable forwardly or rearwardly to open or close the storage compartment, wherein the sliding door is provided between the left and right doors.

7. The refrigerator according to claim 6, wherein:

each of the left and right doors includes a gasket to hermetically seal the storage compartment and absorb shock when the left or right door is closed; and the gasket is provided at the other lateral surface of the left or right door so as to come into contact with a lateral surface of the sliding door when the left or right door is closed.

8. The refrigerator according to claim 6, wherein:

the sliding door includes a rod-shaped supporting shaft vertically installed to support the multistage food accommodation door guards; and each of the multistage food accommodation door guards includes a through-hole for penetration of the supporting shaft and a clamping device to couple or separate the door guard to or from the supporting shaft.

9. The refrigerator according to claim 6, wherein opposite lateral sides of the multistage food accommodation door guards are open to allow food to be stored or retrieved therethrough.

10. A refrigerator comprising:

a cabinet in which a storage compartment is defined; and a door forwardly pivotally rotatably coupled to one side of the cabinet via a hinge member so as to open or close an open front side of the storage compartment, wherein the cabinet includes a protruding portion extending forwardly from a sidewall thereof by a length corresponding to a thickness of one lateral surface of the door, wherein the lateral surface of the door close to the hinge member is hidden by the protruding portion when the door is closed, wherein the protruding portion includes an inner side surface and an outer side surface formed by extending an outer shell of the sidewall of the cabinet, and the inner side surface includes a convexly curved surface, and wherein the lateral surface of the door close to the hinge member includes a concavely curved surface corresponding to the convexly curved surface of the protruding portion so as to surround the protruding portion when the door is pivotally rotated.

11. The refrigerator according to claim 10, wherein the protruding portion further includes a hinge member receptacle formed by cutting the inner side surface to accommodate the hinge member when the door is pivotally rotated.

12. The refrigerator according to claim 11, wherein a rotating shaft of the hinge member is located in the hinge member receptacle of the protruding portion such that a movable end of the hinge member is rotatably coupled to the protruding portion and a stationary end of the hinge member is fixed to the door.

13. The refrigerator according to claim 10, wherein the hinge member has an elongated bar shape and is bent to prevent a body of the hinge member from interfering with the protruding portion when the door is pivotally rotated.

14. The refrigerator according to claim 10, wherein the door includes a hinge member receptacle and a hinge member passage hole, so as not to interfere with a body of the hinge member when the door is pivotally rotated.

* * * * *

UNITED STATES PATENT AND TRADEMARK OFFICE

CERTIFICATE OF CORRECTION

PATENT NO. : 8,454,103 B2
APPLICATION NO. : 13/137429
DATED : June 4, 2013
INVENTOR(S) : Jong Su Jeon et al.

It is certified that error appears in the above-identified patent and that said Letters Patent is hereby corrected as shown below:

In the Claims:

Line 22, Column 8, In Claim 1, delete “blending” and insert -- by extending --, therefor.

Signed and Sealed this
Fifteenth Day of October, 2013

Teresa Stanek Rea
*Deputy Director of the United States Patent and Trademark Office*